US005881156A

United States Patent [19]

Treni et al.

[11] Patent Number: 5,881,156

[45] Date of Patent: Mar. 9, 1999

[54] PORTABLE, MULTI-FUNCTIONAL, MULTI-CHANNEL WIRELESS CONFERENCE MICROPHONE

[76] Inventors: Michael Treni, 248 N. Central Ave., Ramsey, N.J. 07446; Norman Hirschberg, 1030 Pine St., Union, N.J. 07083

[21] Appl. No.: 665,637

[22] Filed: Jun. 19, 1996

Related U.S. Application Data

[60] Provisional application No. 60/000,323 Jun. 19, 1995.

[51] Int. Cl.[6] ..... H04R 1/02

[52] U.S. Cl. ..... 381/91; 381/169; 381/92; 381/77; 379/202

[58] Field of Search ..... 381/91, 88, 169, 381/160, 92, 77, 202, 201, 111, 122; 455/90

[56] References Cited

U.S. PATENT DOCUMENTS

| | | | |
|---|---|---|---|
| D. 277,853 | 3/1985 | Thomas | D14/13 |
| 3,659,056 | 4/1972 | Morrison et al. . | |
| 4,224,482 | 9/1980 | Lese et al. . | |
| 4,229,829 | 10/1980 | Grunwald . | |
| 4,434,507 | 2/1984 | Thomas | 381/92 |
| 4,450,319 | 5/1984 | Lucey . | |
| 4,553,267 | 11/1985 | Crimmins . | |
| 4,555,592 | 11/1985 | Deinzer | 381/91 |
| 4,569,051 | 2/1986 | Feldman . | |
| 4,633,498 | 12/1986 | Warnke et al. . | |
| 4,718,110 | 1/1988 | Schaefer . | |
| 4,831,656 | 5/1989 | Southern et al. | 381/169 |
| 4,879,755 | 11/1989 | Stolarczyk et al. . | |
| 4,908,869 | 3/1990 | Lederman . | |
| 5,095,382 | 3/1992 | Abe . | |
| 5,118,309 | 6/1992 | Ford . | |
| 5,164,984 | 11/1992 | Suhami et al. . | |
| 5,197,098 | 3/1993 | Drapeau . | |
| 5,233,626 | 8/1993 | Ames . | |
| 5,319,805 | 6/1994 | Holcomb et al. | 455/90 |
| 5,359,448 | 10/1994 | Laszlo et al. . | |
| 5,524,059 | 6/1996 | Zurcher | 381/92 |
| 5,548,654 | 8/1996 | Fast | 381/77 |
| 5,596,648 | 1/1997 | Fast | 381/77 |

FOREIGN PATENT DOCUMENTS

| | | |
|---|---|---|
| 2820096 | 11/1979 | Germany . |
| 2137055 | 9/1984 | United Kingdom . |

OTHER PUBLICATIONS

Brochure on Conference–Mate Infrared Listening Systems.

Brochure on Conference Mate The Convenient Remote Microphone.

Data Sheet, Product Description, Conference–Mate CM3XP.

Data Sheet, System Description, CM3–95/250.

Data Sheet, Product Description, Infrared Wireless Conference Microphone.

Data Sheet, Product Description, External DC Power Supply.

Data Sheet, System Description, Infrared Courtroom System.

*Primary Examiner*—Curtis Kuntz
*Assistant Examiner*—Xu Mei
*Attorney, Agent, or Firm*—Sixbey Friedman Leedom & Ferguson; Gerald J. Ferguson, Jr.; Evan R. Smith

[57] ABSTRACT

A wireless conference microphone has a conical base housing with a downward-mounted microphone. A single circuit board is mounted above the microphone, and its circuits transmit the microphone output using infrared diodes on the circuit board, positioned around the periphery of the housing. A battery pack is mounted above the circuit board, and a decorative octagonal cover is provided over the battery pack. A three-position power switch selects either of two transmitting frequencies, and a multi-functional connector selectively interfaces the microphone with external devices, including a mute switch, audio level inputs and outputs, and slave modulators. The microphone can be connected to a like microphone for master-slave operation for use in larger conference rooms.

9 Claims, 4 Drawing Sheets

FIG. 2A
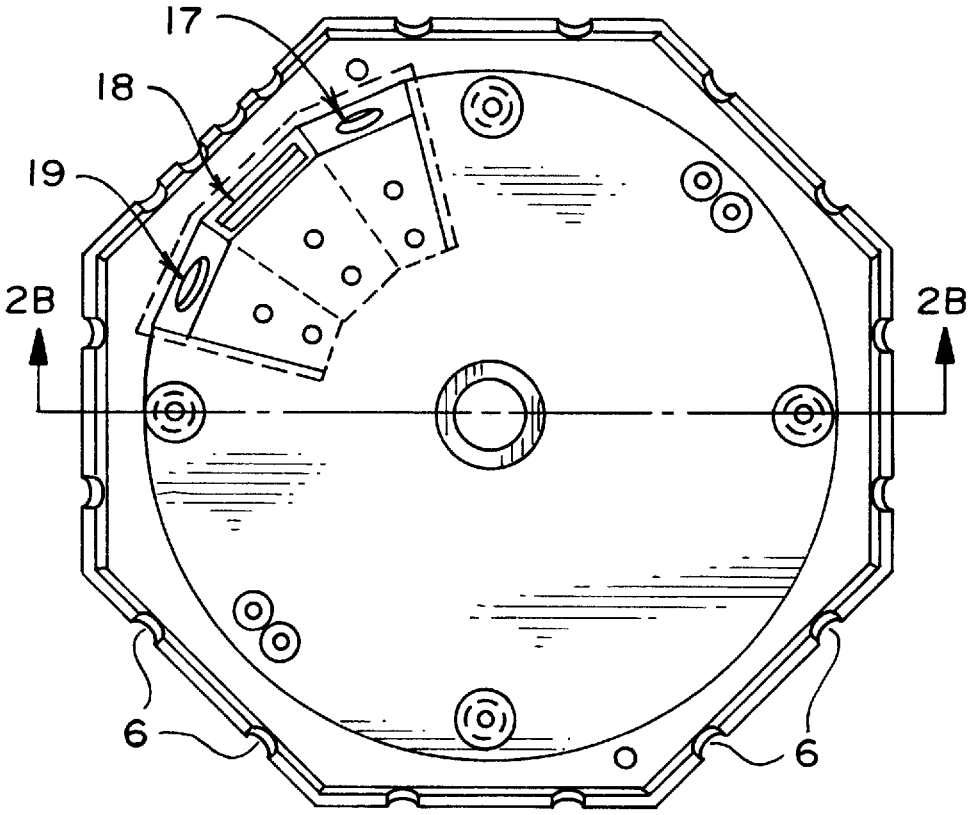
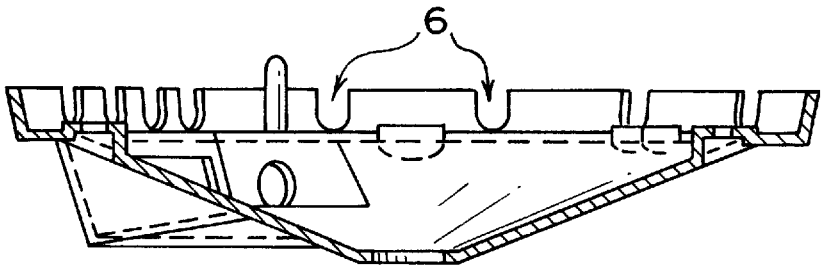
FIG. 2B

PORTABLE, MULTI-FUNCTIONAL, MULTI-CHANNEL WIRELESS CONFERENCE MICROPHONE

This application claims the benefit of U.S. Provisional Application No. 60/000,323 filed Jun. 19, 1995.

FIELD OF THE INVENTION

This invention relates to devices for transducing the speech of a conference group gathered about a table and transmitting this audio signal to wireless infrared receivers in order to provide amplification for hearing impaired listeners, or an audio output to tape recorders, video conferencing systems, and PA systems, etc.

BACKGROUND OF THE INVENTION

Users of wireless systems for hearing assistance and conference recording presently must choose between radio frequency (RF) systems that emit transmissions that can be monitored by unauthorized listeners, hard-wired large area infrared systems which are not easily transported, or portable infrared systems that do not provide adequate transmission coverage for larger rooms.

A variety of prior systems were developed in the wireless microphone field. For example, U.S. Pat. No. 5,359,448 to Laszlo and Geyer shows a battery powered infrared transmitting device with removable and multiple LED configurations. Other prior systems are shown in U.S. Pat. Nos. 4,229,829 to Grunwald, 5,118,309 to Ford, 5,197,098 to Drapeau, 5,164,984 to Suhami et al., 5,319,805 to Holcomb et al., 4,633,498 to Warnke, and German publication DE 28 20 096 of Weidmann.

RF systems, while readily portable, emit radio waves which can easily be received by unauthorized listeners outside the room in which the transmitter is located. This poses a potentially serious security problem in situations such as legal proceedings and high-level business negotiations.

U.S. Pat. No. 4,831,656 to Southern and Treni, and assigned to the assignee of the present application, describes a wireless conference microphone for use with amplification systems for the hearing impaired which is a predecessor of the present invention. An infrared version of this product has been manufactured by Suffridge & Treni under the trademark Conference-Mate®, most recently as model CM3-95/250. An early version of this model was introduced in April, 1994. It included a jack for attaching an external device with a mute switch and an external output for a modulated audio signal. In November, 1994 an enhanced version of the CM3-95/220 was introduced, which incorporates features of the present invention, providing audio in and audio out lines as well as the mute and external output functions in a multi-functional connector, as will be described in more detail below.

While the April 1994 release of the Conference-Mate® CM3-95/250 provided improved performance and includes many desirable features, it was constructed using a wooden enclosure and a large number of separate electronic components. The battery was located at the bottom of the unit, so that removal of the circuits was required to change the battery. Further, infrared versions of this device proved difficult to assemble due to the manner in which the LEDs, required for IR transmission, had to be mounted on the sides of the octagonal housing. The LEDs were mounted separately, wired in series, with the string connected by wire to the transmitter printed circuit board mounted on the top surface of the cone. Thus, the bottom portion and the top portion of the enclosure each carried circuit components and were electrically interconnected, making the device difficult to assemble, disassemble, and repair.

Infrared systems offer a secure transmission medium because the lightwave carrier does not pass through opaque surfaces such as walls. However, a problem with currently available infrared systems is that they are either AC-powered hard-wired types which must be permanently installed in a room, or small battery powered units that do not provide adequate coverage for rooms larger than a typical conference room of approximately 1,000 square feet.

Another problem with currently available infrared systems is that many such systems transmit on fixed modulating frequencies or are not readily changeable between frequencies. While 95 kHz has for years been regarded as a world-wide industry standard for infrared hearing assistance systems, the recent introduction of high efficiency fluorescent lighting which causes interference at 95 kHz has prompted some manufacturers to begin offering 250 kHz systems which are not affected by the new lighting systems. This creates a compatibility problem between older 95 kHz equipment and newer 250 kHz systems.

A more ideal wireless system would be configured for easy assembly and service, emit a secure infrared signal, be battery powered for portable operation, be capable of transmitting in a selectable range of frequencies, and be capable of driving secondary infrared emitters so as to provide additional infrared coverage for larger rooms.

SUMMARY OF THE INVENTION

The present invention comprises an octagonal unit which employs a single condenser microphone mounted at the end of a cone. The cone is suspended above a reflector plate by four posts with the inside of the cone forming a chassis for the electronics and 16 protruding infrared light emitting diodes.

The cone, which is perpendicular to the plate, functions as a significant vertical boundary which deflects the sound waves into the opening of the microphone at the apex of the cone. The reflector plate functions as a horizontal boundary.

The output of the microphone is amplified and then frequency modulated by the voltage controlled oscillator (VCO) in the electronic circuitry. The output of the VCO is sent to two (2) strings of eight infrared LEDs. This dual string arrangement enables the device to operate for longer periods of time with fewer battery cells, thereby reducing both the size and weight of the device. The dual string arrangement also ensures that the device will continue to emit its infrared signal even if one of the strings fail. This is accomplished by installing LEDs of each string alternately about the periphery of the device.

The electronics are mounted on the upper surface of the cone which is formed to create a chassis for the printed circuit board containing the electronics and the protruding LEDs. The cone is slotted along each of its eight sides so that 2 LEDs protrude from each side. This arrangement provides for a uniform infrared transmission from all sides of the device. Additional slots are provided for indicator LEDs, switches, and output devices including the multi-functional connector. A decorative wood enclosure covers the top of the cone, concealing the electronics from view, and provides additional isolation for the microphone from extraneous sound waves.

Significantly, the various parts are designed and constructed in such a way as to afford an easy and rapid method of assembly and service.

The multi-functional connector mounted on the cone-chassis enables one or more external devices to be connected to the portable microphone/transmitter unit. Functions available through the multi-functional connector may include: microphone muting, modulated audio output for secondary emitters, line level audio output to external recording devices, microphone level audio input from external microphones, and line level audio input from external sources such as PA systems or other audio and video systems.

The modulated audio output provides for synchronous emission from secondary emitters, to eliminate the problem of beating that would occur with out-of-phase modulators.

These various external connection functions may be accessed through an accessory device that is comprised of a mating multi-pin audio plug connected by a cable to an enclosure which houses additional electronic circuitry to process incoming and outgoing audio signals and individual ports for each of the functions that are required.

Accordingly, one object of the invention is to provide a new and improved wireless conference microphone that can provide a secure infrared transmission.

Another object of the invention is to provide a new and improved wireless conference microphone that can operate for longer periods of time using minimal battery power.

Another object of the invention is to provide a new and improved wireless conference microphone that can easily be configured to transmit in a selectable range of frequencies.

Another object of the invention is to provide a new and improved wireless conference microphone that can be connected to external devices through a multi-functional connector.

Another object of the invention is to provide a new and improved wireless conference microphone that is capable of driving secondary infrared emitters to provide additional infrared coverage for larger rooms.

A further object of the invention is to provide an improved conference microphone which will operate with a like microphone in a master-slave configuration for large conference rooms.

A more specific object of this invention is to provide a new and improved wireless conference microphone utilizing a conical member that forms a chassis for electronics and protruding infrared LEDs, with such conical member suspended above and parallel to a reflector plate, with a microphone mounted in an aperture at the apex of the conical member, with the electrical output of the microphone amplified, frequency modulated and transmitted by two strings of eight infrared light emitting diodes in a selectable range of frequencies, and with a multi-functional connector that enables the device to be connected to external sources such as secondary emitters and audio/video systems.

BRIEF DESCRIPTION OF THE DRAWINGS

FIG. 2A is a top view of the cone-chassis according to the present invention;

FIG. 2B is a side sectional view of the cone-chassis;

DETAILED DESCRIPTION OF PREFERRED EMBODIMENTS

As will be seen from the following description, the present invention provides a more manufacturable and serviceable product as compared to prior art systems, because of the configuration and interaction of the assembled components. The unit can be quickly assembled and disassembled for repair and has more reliable construction, resulting in lower manufacturing costs, as compared to prior art units.

Figure 1B:
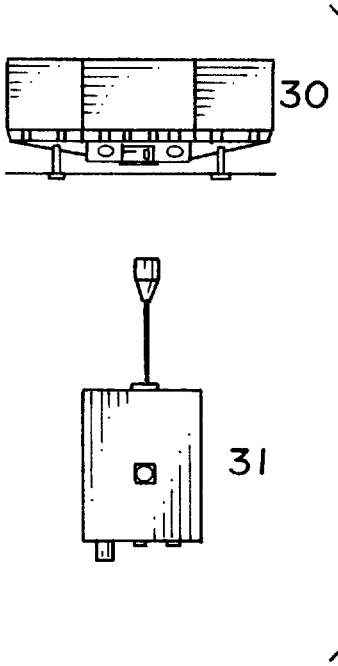
FIGS. 1A and 1B are an assembly drawing and a plan view, respectively, showing the microphone/transmitted unit of the present invention.
Figure 1A:
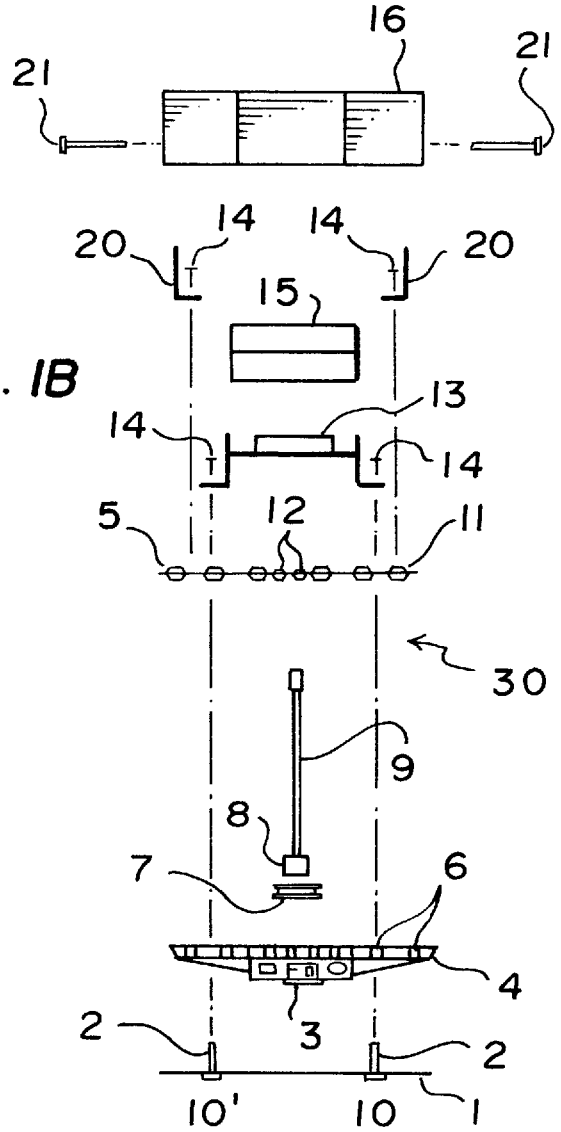

Referring now to FIG. 1A, microphone/transmitter unit 30 comprises reflector plate 1, posts 2, cone chassis 4 with aperture 3 and cutouts 6, printed circuit board 5, isolating rubber sleeve 7, microphone 8, microphone wires 9, rubber pads 10, infrared LEDs 11, indicator LEDs 12, battery tray 13, assembly screws 14, batteries 15, octagonal cover 16, charging port 17, power switch 18, multi functional connector 19, metal clips 20, and cover mounting screws 21.

The single microphone 8 is surrounded by isolating rubber sleeve 7 and mounted in aperture 3 at the apex of inverted frustoconical cone-chassis 4. Cone-chassis 4 may be formed of black plastic. The use of a plastic cone provides more interior room than the wooden cone used in the inventor's previous product, which permits mounting of the circuitry (including LEDs) on a single printed circuit board, and allows for easy removal of the battery.

Cone-chassis 4 is located axially perpendicular to, and suspended above, reflector plate 1 by four posts 2 which are affixed at their upper ends to the base of cone-chassis 4 by four screws 14 which also connect octagonal printed circuit board 5 and battery tray 13 to posts 2.

Rubber pads 10 mounted on the bottom of reflector plate 1 isolate the unit from the transmission of mechanical vibrations from a table or other surface upon which unit 30 is placed.

Octagonal-shaped printed circuit board 5 contains the electronic circuitry and 16 protruding infrared LEDs 11, and is mounted on the upper surface of the cone-chassis 4 with the 16 protruding infrared LEDs 11, control indicator LEDs 12, power switch 18, charging port 17, and multi-functional connector 19 mounted in cutouts 6 in cone-chassis 4. The 16 infrared LEDs 11 are mounted radially on octagonal printed circuit board 5 with two LEDs on each side thereof, one from each string. LEDs 11 align with and protrude through cutouts 6 in cone-chassis 4 when circuit board 5 is installed in cone-chassis 4. This provides an improved method of mounting the LEDs by incorporating them on the same printed circuit board as the transmitter, preamplifier, and battery management circuitry.

Microphone 8 is connected to the octagonal printed circuit board 5 by microphone wires 9. Metal tray 13 for holding the batteries 15 rests above the printed circuit board 5 and is secured by the four screws 14 which pass through holes in the battery tray 13, printed circuit board 5, cone-chassis 4, and thread into the four posts 2 protruding from reflector plate 1. Thus, batteries 15 are positioned for ready access and replacement upon removal of cover 16. Batteries 15 preferably comprise a nickel-cadmium battery pack or similarly rechargeable batteries.

Machined octagonal wooden cover 16 is secured to the cone-chassis 4 using two metal clips 20 and two cover mounting screws 21 which pass through the wooden cover 16 and are threaded into metal clips 20. Cover 16 is preferably of oak or other fine hardwood, decoratively finished.

The microphone structure, including the configuration and angle of the reflector plate, are in general constructed according to the disclosure in U.S. Pat. No. 4,831,656 to Southern and Treni, which is incorporated herein by reference. Microphone 8 is mounted at the end of the frustoconical cone-chassis 4 which is suspended above and perpendicular to horizontal reflector plate 1. Frustoconical cone-chassis 4 also forms a chassis for the electronics and 16 LEDs which protrude from the frustoconical member in a 360 degree arc on a horizontal plane. An angled opening between the cone-chassis and reflector plate 1 deflects the sound waves emanating from any conversations around the table directly into the microphone. The opening from the microphone is the same from any side of the device producing uniform directional characteristics so that all conference participants can be equally heard. The 360 degree mounting arrangement of LED's provides for an equally uniform distribution of the infrared transmission.

Multi-functional connector 19 makes it possible to connect the device to secondary infrared emitters, a device to remotely mute the microphone, and also provides a path for audio and modulated signals at various stages of the electronic circuitry to be connected to external audio/video sources and/or recording devices.

FIG. 1B is a side view of the assembled microphone/transmitter unit 30, together with a top view of accessory unit 31.

FIG. 2A is a top view of cone-chassis 4 according to the present invention, and FIG. 2B is a side sectional view of cone-chassis 4.

Figure 3:
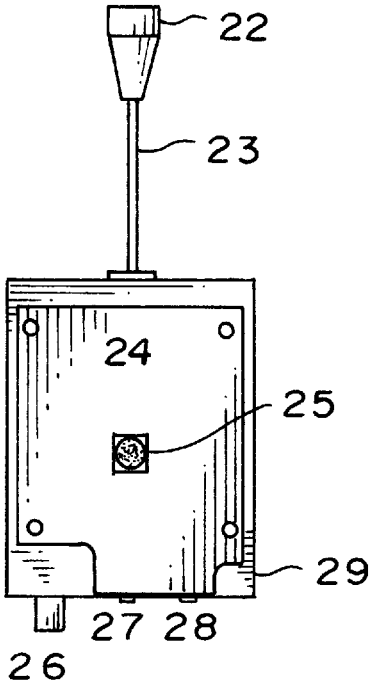
FIG. 3 is a top view of an accessory unit used with the invention.

FIG. 3 shows accessory unit 31, which comprises a plastic enclosure 29 which holds printed circuit board 24, switch 25, secondary emitter port 26, line level input 27, and line level output 28. Accessory unit 31 is connected to microphone/transmitter unit 30 using multi pin audio plug 22 and multi conductor cable 23.

Multi-pin audio plug 22 mates with multi functional connector 19 of the main unit 30 and is attached to multi-conductor cable 23 which connects the electronic circuitry of the main unit 30 to accessory unit 31. Printed circuit board 24 contains electronic circuitry, microphone muting switch 25, and separate audio ports including frequency modulated output port 26 for a secondary emitter, and line level input 27 and line level output 28 for other external audio devices, and is mounted in plastic enclosure 29.

Figure 4:
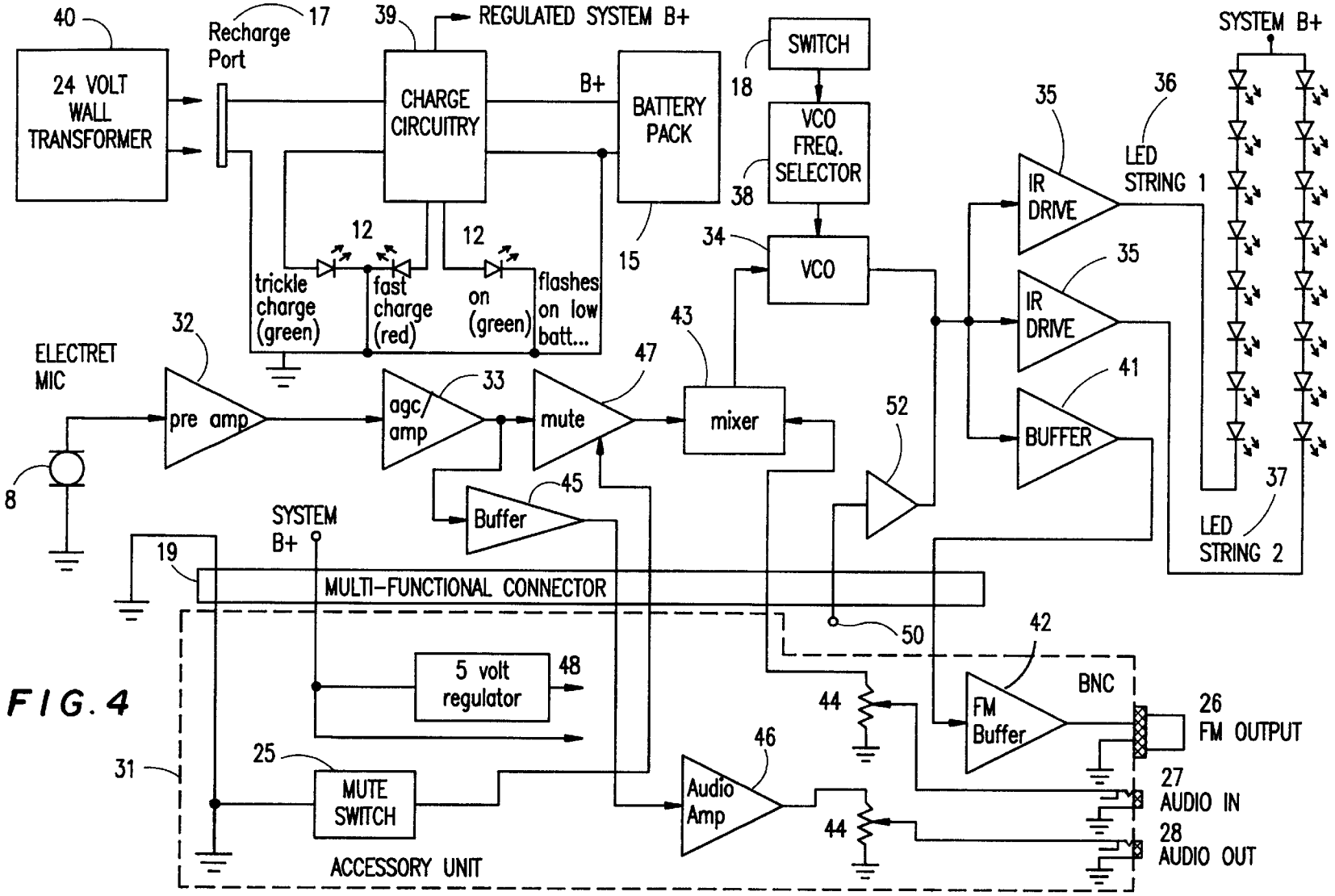
FIG. 4 is a block diagram of the electronic circuitry of the invention.

FIG. 4 shows the electronic circuitry of the device in block diagram form. As shown in FIG. 4, the circuits include preamplifier stage 32, amplifier 33, voltage controlled oscillator 34, infrared driver circuits 35, LED string 36, LED string 37, VCO frequency selector 38, microprocessor controlled charge circuit 39, wall transformer 40, buffer circuits 41 and 42, audio mixing network 43, resistor 44, buffer circuit 45, audio amp 46, muting circuit 47, voltage regulator 48, modulated IR drive input 50, and buffer circuit 52.

The output of microphone 8 is amplified by preamplifier stage 32 and automatic gain control amplifier 33 and then frequency modulated by VCO 34. The modulated signal passes through two infrared driver circuits 35 which feed two separate LED strings 36 and 37 in the LED array, making up LEDs 11 (shown in FIG. 1). The use of two LED strings reduces battery voltage requirements and provides redundancy so that if one string fails, the other may continue to operate.

The output frequency of VCO 34 is controlled by a series of resistors in VCO frequency selector 38. The operating frequency of the device is selected by switching one of the resistors into the circuit using, for example, a 3-position power switch 18 mounted on the cone-chassis. This arrangement allows the user to select one of two different operating frequencies available from the frequencies programmed in the VCO frequency selector 38. Preferably, frequencies of 95 khz and 250 khz may be selected to provide compatibility with either of the most prevalent receiving devices. However, any two frequencies may be selected for switch-selected operation by providing appropriate resistors associated with voltage controlled oscillator frequency selector 38. Alternatively, a multi-position switch may be provided to select among more than two frequencies. There are four wideband frequencies currently available (including 95 kHz, 250 kHz, 2.3 MHz, 2.8 MHz) and 32 narrow-band channels. A selector could be provided to select among a plurality of any of these channels. Preferably, an internal DIP switch array or jumper array can be provided to select two of these possible frequencies for use, and the frequency can then be selected among these two by the three-position power switch. The incorporation of the frequency selection function into power switch 18 provides user control while minimizing the number of externally mounted switches and contacts. At the same time, this frequency selection control provides significant advantages over prior art methods which used jumpers on the circuit board.

Microprocessor controlled charge circuit 39 regulates current to infrared LED strings 36 and 37 and controls the time and rate of charge to batteries 15. Power to recharge batteries 15 is supplied by external 24 volt wall transformer 40 through charging port 17 which is mounted on the cone-chassis. Indicator LEDs 12 protrude through the cone chassis to provide information to the user on the status of battery charging and operation.

Various input and output signals are connected through the multi-functional connector 19 and sent to accessory unit 31 or to another unit 30 operating in a master-slave configuration, as will be described in more detail below.

Frequency modulated audio, available from VCO 34, passes through two buffer circuits 41 and 42. These circuits isolate the infrared driver circuits 35 of the microphone/transmitter unit from optional, external secondary emitters (and/or slave units) which may be connected to it through FM output port 26. Any slave emitters connected to unit 30 use the modulated output signal from the self-contained microphone/transmitter to control their emissions, eliminating the problem of beat signals that may occur with multiple modulators when the modulators are out of phase.

Audio mixer 43 mixes both the incoming signal of the microphone 8 and external audio devices which are connected through the accessory unit 31, or otherwise provided through multi-functional connector 19. As will be seen, this function enables connection of two microphone/transmitter units by a cable to provide a master-slave configuration.

Incoming audio signals from external devices are connected through audio input port 27 located on the accessory unit 31. A variable resistor 44 regulates the level of the incoming signal to the mixer 43.

An unmodulated audio output is also available from the output of AGC amplifier 33. This signal passes through a buffer circuit 45, out the multi-functional connector 19 and into accessory unit 31. This signal is amplified by audio amp 46 and can be connected to external audio devices through audio line level output 28 located on the accessory unit 31. A second variable resistor 44 regulates the level of the outgoing signal.

Muting of microphone 8 is controlled by a mute switch 25, located on accessory unit 31, which in turn controls muting circuit 47 located in the main unit. Placing the muting circuit 47 in the microphone input circuit prior to mixer 43 allows the user to disable only the microphone 8, allowing the microphone/transmitter to be used as a "slave" modulator/transmitter and operate with external audio sources, or to operate as a slave transmitter operating with an external modulated signal source.

Accessory unit 31 is preferably powered by the main system's power which passes through the multi-functional connector 19. Regulator 48 reduces the voltage to a 5-volt level required to operate the accessory unit's circuitry.

Figure 5:
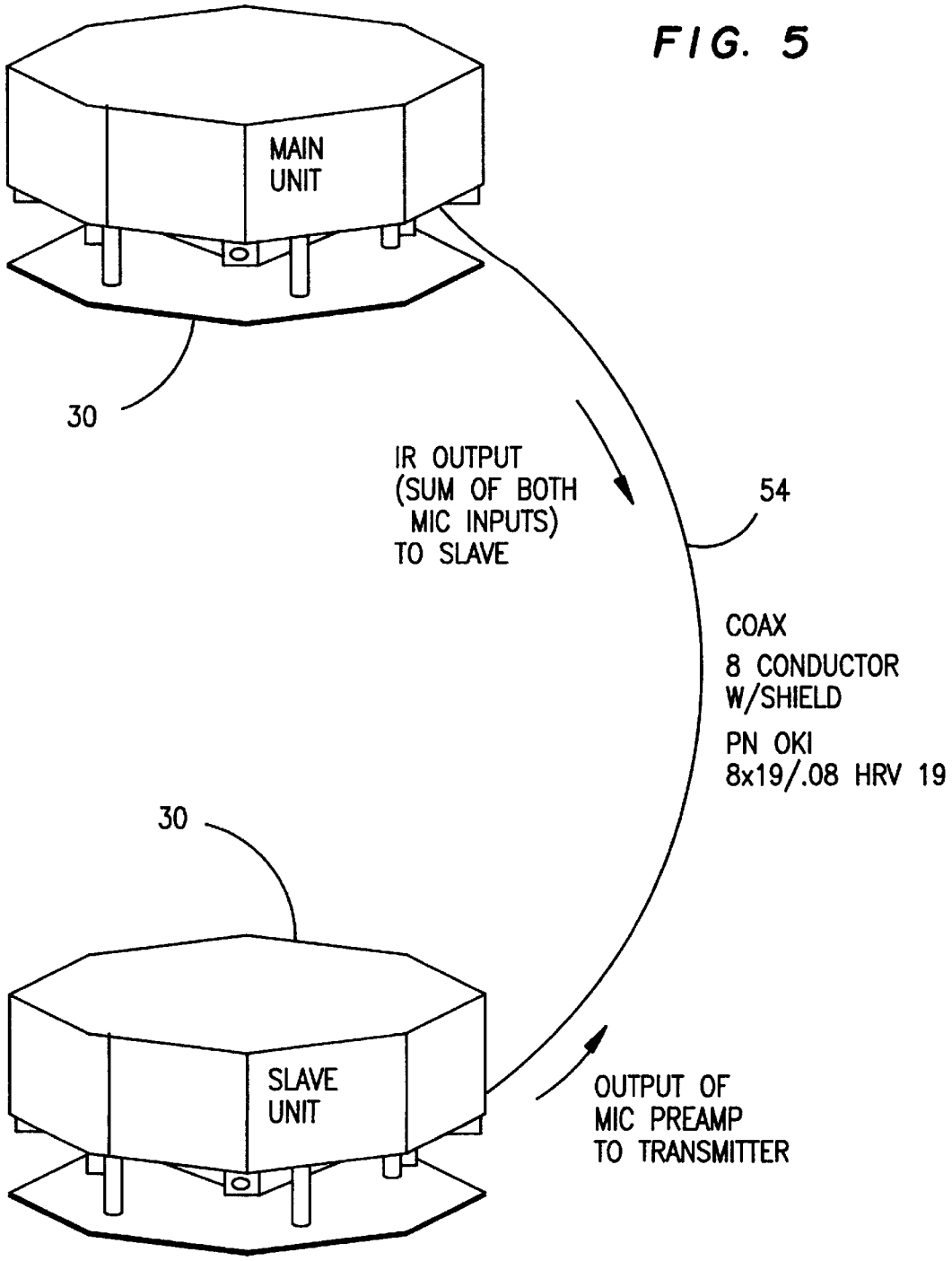
FIG. 5 shows two devices connected in a master-slave configuration.

The specific electronic circuits provided in the invention, and the provision of the specific output connections described above, facilitates interconnection of two such units 30 in a "master-slave" configuration as shown in FIG. 5. The FM output 26 of the master unit is connected to the FM input 50 of the slave unit, and the audio output 28 of the slave unit is connected to the audio input 27 of the master unit. These connections are preferably made by an appropriate wire 54 connected between the multi-functional connectors 19 of the two units, which may be an 8-conductor coaxial cable.

In this configuration, the internal microphone of one microphone/transmitter unit can be used to send a pre-modulated signal to the "master" microphone/transmitter unit 30 which combines this signal with its own microphone signal to produce a modulated IR driving signal based on the signals of both microphones. This combined IR driving signal generated by the master unit is then passed back to the slave unit and used to control its LED transmissions. In this manner, in a large conference room, two generally identical units can be interconnected and the units will simultaneously transmit sounds picked up from both locations.

The above-described arrangements are merely illustrative examples of the application. Numerous other arrangements may be readily devised by those skilled in the art which will embody the principles of the invention and fall within the spirit and scope thereof.

I claim:

1. A wireless conferencing apparatus adapted for placement on a surface, comprising:

a base housing comprising a circuit board mounting portion, and a frustoconical portion with a cross-sectional diameter increasing along a central axis of said frustoconical portion from a minimum point at an aperture located on said central axis to a maximum point adjacent said circuit board mounting portion;

means for supporting said base housing to position it proximate to and above the surface, with said aperture facing said surface, and said circuit board mounting portion above said frustoconical portion;

a microphone mounted in said aperture of said base housing;

a circuit board connected to said microphone and mounted in said circuit board mounting portion, said circuit board having mounted thereon amplifier means for amplifying an output of said microphone to produce an amplified output, modulating means connected to said amplifier means for modulating said amplified output to produce a modulated output; and infrared transmitting means mounted on said circuit board and protruding through at least one aperture in said circuit board mounting portion for infrared transmission of said modulated output;

battery mounting means located above the circuit board mounting portion for supporting at least one battery in a position above the circuit board;

battery means connected to the circuit board for powering the amplifier means, the modulating means, and the infrared transmitting means; and a removable decorative cover mounted above said base housing adjacent to said circuit board mounting portion of said base housing to cover said battery mounting means and said battery means.

2. The apparatus of claim 1 wherein, in said circuit board mounting portion, said at least one aperture through which the infrared transmitting means protrudes comprises a plurality of apertures, each open at a top part of the aperture so that the circuit board can be installed in the circuit board mounting portion by aligning the infrared transmitting means with said plurality of apertures and dropping the board into place.

3. The apparatus of claim 1 further comprising:

external connection means for providing an electrical connection between external devices and said circuit board; and a modulated audio input line connected between said modulation means and said external connection means.

4. The apparatus of claim 3 further comprising slave operating means connected to said modulation means and said modulated audio input line for controlling the conference microphone in a slave mode to receive a modulated signal from an external source and retransmit the modulated signal using said infrared transmission means.

5. The apparatus of claim 3 further comprising an audio output line connected between said circuit board and said external connection means for transmitting an audio microphone signal to an external infrared emitting device.

6. The apparatus of claim 1 further comprising multi-functional connector means for providing a single external jack having connections for: a microphone muting control line, modulated audio output, and audio input.

7. The apparatus of claim 6 further comprising an accessory unit, a cable connecting said accessory unit to the multi-functional connector means via connections for the microphone muting control line, modulated audio output, and audio input, wherein said accessory unit has mute switching means connected to the microphone muting control line for selectively inhibiting microphone input, and jack means for providing audio cable connections to each of the modulated audio output and audio input lines.

8. A compact wireless conferencing unit adapted for placement on a surface, comprising:

a housing with a circuit board mounting portion;

a microphone mounted in said housing;

a circuit board connected to said microphone, said circuit board having amplifier means for amplifying an output of said microphone to produce an amplified output, modulating means connected to said amplifier means for modulating said amplified output to produce a modulated output; and infrared transmitting means mounted on said circuit board and protruding through at least one aperture in said circuit board mounting portion for infrared transmission of said modulated output;

slave operating means for linking the unit to a similar unit so that both units will synchronously transmit infrared signals representing the sum of sounds picked up by the microphones of both units, the slave operating means including:

external connection means for providing an electrical connection between external devices and said circuit board;

a modulated audio input line connected between said modulation means and said external connection means; and an audio output line connected between said microphone and said external connection means.

9. The unit of claim 8 wherein the housing has a frustoconical portion with a cross-sectional diameter increasing along a central axis of said frustoconical portion from a minimum point at an aperture located on said central axis to a maximum point adjacent said circuit board mounting portion, with said microphone mounted in said aperture; and further comprising:

means for supporting said base housing to position it proximate to and above the surface, with said aperture facing said surface, and said circuit board mounting portion above said frustoconical portion;

battery mounting means located above the circuit board mounting portion for supporting at least one battery in a position above the circuit board;

battery means connected to the circuit board for powering the amplifier means, the modulating means, and the infrared transmitting means; and a removable decorative cover mounted above said base housing adjacent to said circuit board mounting portion of said base housing to cover said battery mounting means and said battery means.

* * * * *